United States Patent [19]

Forster

[11] Patent Number: 4,576,294

[45] Date of Patent: Mar. 18, 1986

[54] VEHICLE COUPLER DEVICE HAVING MEANS FOR TAKING EXCESS IMPACTS

[75] Inventor: Hilmar Forster, Wolfenbüttel, Fed. Rep. of Germany

[73] Assignee: Scharfenbergkupplung GmbH, Fed. Rep. of Germany

[21] Appl. No.: 470,307

[22] Filed: Feb. 28, 1983

[30] Foreign Application Priority Data

Aug. 3, 1982 [DE] Fed. Rep. of Germany ..... 3228941

[51] Int. Cl.[4] ..... B61G 9/04

[52] U.S. Cl. ..... 213/9; 213/1 A; 213/220

[58] Field of Search ..... 213/220, 221, 222, 223, 213/1 A, 9; 293/134, 135, 133

[56] References Cited

U.S. PATENT DOCUMENTS

| | | | |
|---|---|---|---|
| 72,891 | 12/1867 | Pennock | 213/221 X |
| 1,251,685 | 1/1918 | O'Connor | 213/222 |
| 1,339,743 | 5/1920 | Davis | 213/221 |
| 1,530,017 | 3/1925 | Souliotis | 293/134 |
| 2,802,580 | 8/1957 | Larsson | 213/221 X |
| 2,873,994 | 2/1959 | Omps | 213/1 A |
| 3,149,731 | 9/1964 | Dunlop | 213/9 |
| 3,247,977 | 4/1966 | Dilg | 213/221 X |
| 3,899,047 | 8/1975 | Maeda et al. | 293/133 |
| 4,375,857 | 3/1983 | Günther et al. | 213/220 |

FOREIGN PATENT DOCUMENTS

| | | | |
|---|---|---|---|
| 1124536 | 3/1962 | Fed. Rep. of Germany | 213/1 A |
| 14023 | of 1912 | United Kingdom | 213/222 |

*Primary Examiner*—Robert B. Reeves
*Assistant Examiner*—Dennis C. Rodgers
*Attorney, Agent, or Firm*—McGlew and Tuttle

[57] ABSTRACT

In a rail vehicle with anticlimb equipment, the occurring normal shocks are absorbed by draw and buffer devices which are provided in tandem with the central buffer couplers. To take up excessive impacts, an excess-impact safety effective through deformation is built into the coupler bar of the central buffer coupler. The purpose of the inventive arrangement with an additional excess-impact safety is to be able, upon a collision accident, to take up further excess impacts, in addition to those which are absorbed by the excess-impact safety of the coupler bar. The additional excessive-impact safety is so disposed that it remains unaffected during the response of the excess-impact safety of the coupler bar.

1 Claim, 5 Drawing Figures

22
30
5
15 c
8
32
6a
6b
8a
11
a
7
6
d
9
b
2a
10
1a
20
2
4
2b
3
1

22
5
30
15

6a
6b
c
32
8
11
8a
7
6
2a
2b
d
9
10
1a
20
2
4
3
1

22
30
c
5

6b
32
6a
8
11
8a
7
6
2a
2b
15
9
10
1a
20
2
4
3
1

VEHICLE COUPLER DEVICE HAVING MEANS FOR TAKING EXCESS IMPACTS

FIELD AND BACKGROUND OF THE INVENTION

This invention relates in general to the construction of couplers for vehicles and in particular to a new and useful coupler particularly for rail vehicles which includes means for absorbing excess impacts such as would occur in collisions.

A similar safety device is disclosed in German Pat. No. 1,530,223. In this device the magnitude of the absorbable shock is determined by the wall thickness and length of a hollow cylinder. Since the normal impacts to which the central buffer coupler is exposed are absorbed by a draw and buffer device provided in tandem therewith, the safety device may become effective under impacts exceeding a force of 2 million Newtons. Consequently, the safety device is relatively heavy, and, primarily it has a great overall length so that its use in practice is limited.

It is further known, from German Pat. No. 1,912,049, to provide a double-walled safety device, to be able to take up greater shocks with the same overall length of the device. Experience has shown, however, that with a frequent exposure to shocks at the limit of endurance, the excessive-shock absorbing capacity of the device lessens, since the device is located in the line of action of the forces. To ensure an effective protection of the travelers, especially in street cars and local transportation, the front walls of the vehicles are provided with anticlimb fenders intended to prevent the vehicles from wedging into one another under an excessive impact.

SUMMARY OF THE INVENTION

The invention is directed to a design permitting a further deformable safety device in a central buffer coupler arrangement to take up still more excessive impacts.

In accordance with the invention, a vehicle coupler device particularly for rail vehicles comprises a shock absorber assembly which includes a plurality of telescopic elements including a shock bar. The elements are biased in a separator or extended position by a biasing arrangement which, for example, may be fluid pressure. The shock bar assembly has one end adapted to be secured to the vehicle and an opposite end extending outwardly of the vehicle with a fender secured to this end which has a plate part which is spaced from the end of the vehicle. The telescopic elements making up the shock bar includes a first impact safety between a shock bar portion and the end of the vehicle which comprises one part which is yieldably movable in respect to the other upon excess impact. The web plate is secured to the shock bar assembly and it carries a central buffer coupler which has one end with a coupler head having a plate part extending outwardly of the vehicle beyond the fender plate of the shock bar. The central buffer coupler has a second impact safety comprising one second impact safety part which is movable relative to another second impact safety part upon the occurrence of a predetermined safety impact. The plate part of the coupler head extends beyond the end of the vehicle and beyond the plate part of the fender by an amount substantially equal to the movement of the parts of the possible movement of one second impact safety part relative to another second safety impact part. The fender plate of the shock bar assembly is spaced ahead of the vehicle by an amount equal to the movement of the one first impact safety part relative to another first impact safety part.

Accordingly, it is an object of the invention to provide a coupler particularly for rail vehicles which includes additional safety devices for absorbing impact stresses and which are effective in respect to the mounting of a central coupler head relative to a shock bar and in respect to the shock bar mounting to the housing of the vehicle.

A further object of the invention is to provide a coupling construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
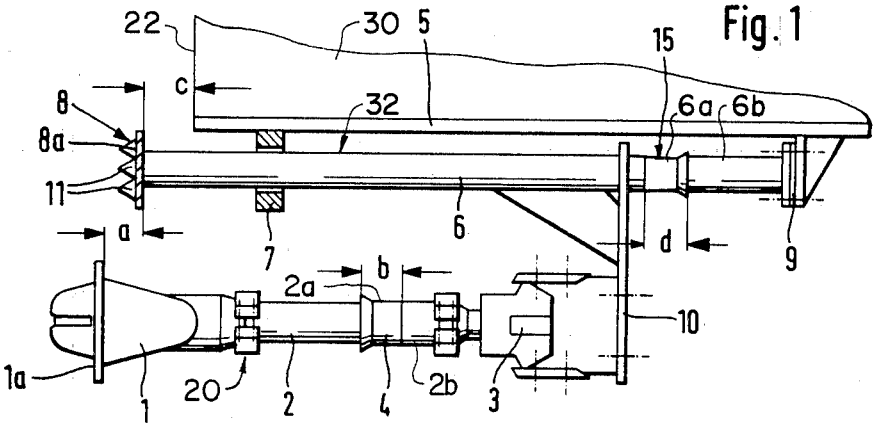
FIG. 1 is a side elevational view partly in section of a rail vehicle having a coupler constructed in accordance with the invention.

Referring to the drawings in particular the invention embodied therein comprises a coupler device particularly for a rail vehicle 30 and which includes a shock bar assembly generally designated 32 which comprises a plurality of telescopic parts 6,6*a*,6*b* including a shock bar 6 which are held in an extended position by a yieldable biasing mechanism within the associated cylinders which for example may comprise fluid under pressure. The shock bar assembly 32 includes one end which is adapted to be secured to the vehicle 30 and for this purpose it is shown as being connected to a bracket 9 which is affixed to the vehicle undercarriage 5. The opposite end of the shock bar assembly 32 extends outwardly of the vehicle and carries an anticlimb fender assembly 8 which has a plate part 8*a* which is spaced outwardly of an end wall 22 of the vehicle 30. The shock bar assembly 32 includes a first impact safety 15 between the shock bar 6 and the end of the assembly which is connected to the vehicle and which comprises one safety impact part movable in respect to another safety impact part as will be explained later.

In accordance with the invention, a web plate 10 is secured to the shock bar assembly 32 and it carries a central buffer coupler generally designated 20 which includes a plurality of telescopic parts 2,2*a*,2*b* which includes a second impact safety which comprises one second impact safety part 2*a* movable relative to another second safety impact part 2*b*. Part 2 is a drawbar for the coupler. The central buffer coupler 20 has one end with a coupler head 1 with a plate part 1*a* extending outwardly beyond the end 22 of the vehicle by an amount a+c and beyond the plate part 8*a* of the fender 8 by an amount a which is substantially equal to the amount of movement of the one second impact safety part relative to the other second impact safety part. As noted above, the central buffer coupler 20 comprises the coupler head 1 and the draw bar 2 which, in a manner known per se, is designed with a draw and buffer device 3, and a mechanically deformable safety device 4 intended for taking up excessive impacts. Below the undercarriage 5, and spaced from and parallel to the central buffer coupler, the shock bar 6 is mounted for axial displacement in a guide 7. On one of its ends, shock bar 6 carries the anticlimb fender 8, while on its other end, the bar is connected through bracket 9 to undercarriage 5. Through the web plate 10, the central buffer coupler is mounted on shock bar 6 for horizontal pivotal motion, in a manner such that in normal position, draw bar 2 and shock bar 6 extend in a common central vertical plane of undercarriage 5, and the plate part 1*a* of the coupler head 1 extends ahead of the front surface 8*a* of anticlimb fender 8 by the predetermined distance a which corresponds to the depth b to which safety device 4 is compressible (FIG. 1).

Figure 4:
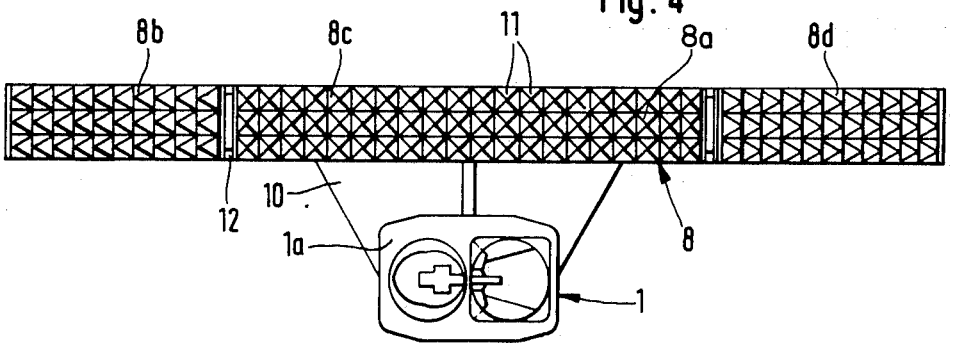
FIG. 4 is a front elevational view of the coupler shown in FIG. 1.
Figure 5:
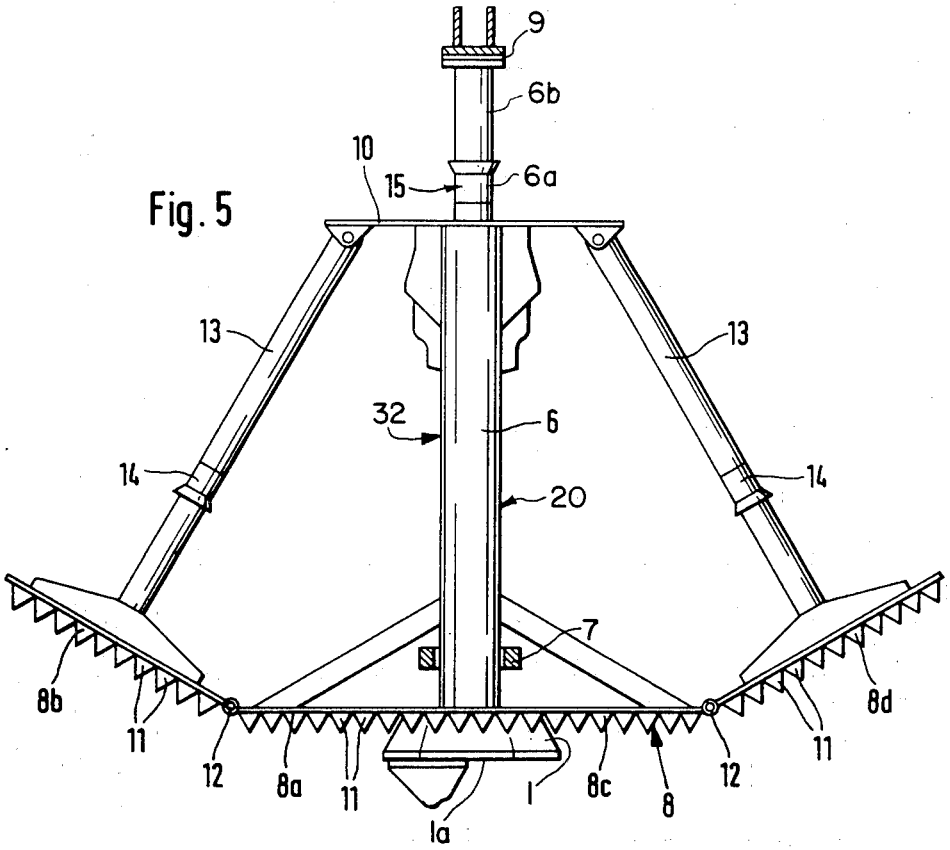
FIG. 5 is a partial top plan view of the shock bar assembly shown in FIG. 1.

Plate part 8*a* of fender 8 is designed with a plurality of pyramidal projections 11 arranged in adjacent rows, and may be subdivided into three individual adjacent fender parts 8*b*, 8*c* and 8*d* as shown in FIGS. 4 and 5, which are connected to each other by hinges 12. In such a design, anticlimb fender part 8*c* extends parallel to the front end wall 22 of the undercarriage, while fender parts 8*b* and 8*d* extend at an oblique angle to part 8*c* to be effective in a sideward collision. Anticlimb fender part 8*c* is secured to shock bar 6 directly, while fender parts 8*b* and 8*d* are hinged thereto, preferably through web plate 10; and each separately through a shock rod 13 which is adjustable in length and includes a deformable excess impact safey 14. Between web plate 10 and bracket 9, an excess impact safety 15 is built into shock bar 6, whose depth of compression d (FIG. 2) upon a deformation corresponds or is equal to the spacing c of plate part 8*a* from the front end wall 22 of the vehicle.

Figure 2:
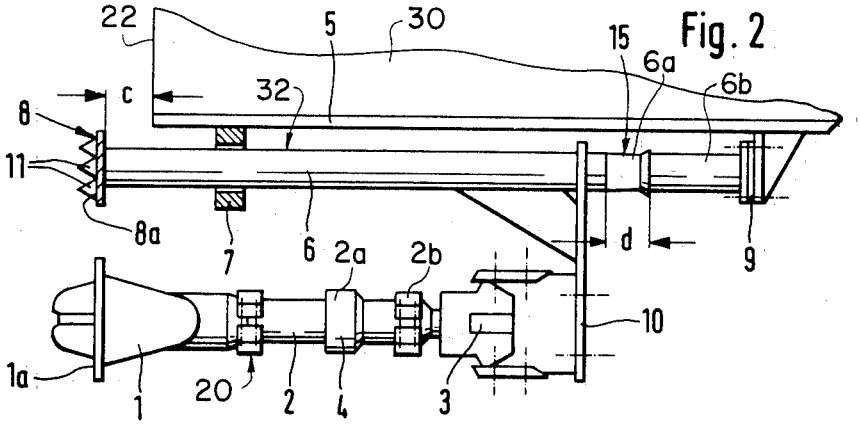
FIG. 2 is a view similar to FIG. 1 showing a position of the parts upon excessive impact.
Figure 3:
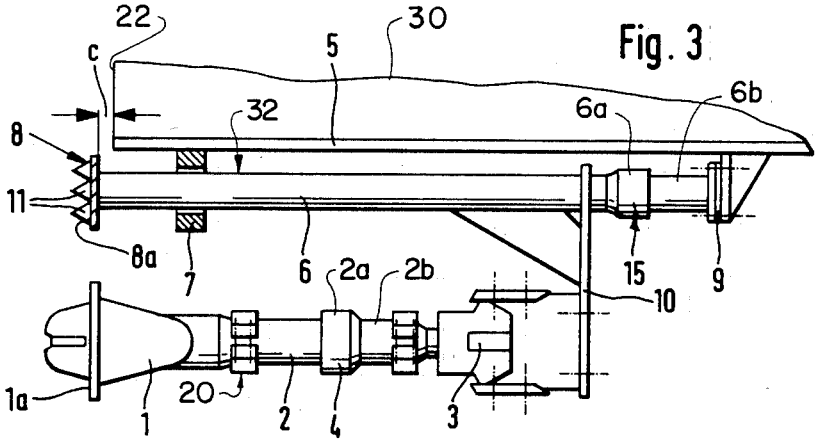
FIG. 3 is a view similar to FIG. 2 showing the parts with an additional excessive impact.

The impact forces normally acting on coupler head 1 are absorbed by draw and buffer device 3. An excessive impact is absorbed by a deformation in safety device 4, with the central buffer coupler 20 being compressed to an extent such that plate part 1*a* is displaced into the same vertical plane in which plate part 8*a* extends (FIG. 2). If a further excessive impact occurs, the forces in excess act both on anticlimb fender 8 and on the central buffer coupler, and are transmitted partly directly and partly indirectly through web plate 10 into shock bar 6 where they are taken up by excess impact safety 15 (which is made up of parts 6*a* and 6*b*).

Upon an excessive impact, the colliding anticlimb fenders of the involved vehicles become interlocked due to the projections 11 provided on front surfaces 8*a* and prevent the vehicles from swerving upwardly, downwardly, or aside.

While specific embodiments of the invention have been shown and described in detail to illustrate the application of the principles of the invention, it will be understood that the invention may be embodied otherwise without departing from such principles.

What is claimed is:

1. A coupler device for a rail vehicle, comprising a shock absorbing bar assembly comprising a plurality of telescopic elements including a shock bar, said shock absorbing bar assembly having one end adapted to be secured to the vehicle and an opposite end extending outwardly from the vehicle, a fender secured to said opposite end and having a plate part spaced from the end of the vehicle by a first amount, said telescopic elements including a first impact safety between said shock bar and the end of said shock absorbing bar assembly which is connected to the vehicle, said first impact safety comprising one first impact element movable in respect to another first impact element and permanently deformable upon the occurrence of an emergency impact force, a web plate secured to said shock absorbing bar assembly, a central buffer coupler carried by said web plate, said central buffer coupler having a second impact safety comprising one second impact element movable relative to another second impact element and permanently deformable upon the occurrence of another emergency impact force, said central buffer coupler having one end with a coupler head having a plate part extending outwardly of the vehicle beyond said fender plate part and by a second amount substantially equal to an amount of movement of said one second impact element relative to said other second impact element, said fender plate part being spaced ahead of said vehicle by said first amount which is at least greater than an amount of movement of said one first impact element relative to said other first impact element, the emergency impact force needed to permanently deform said first impact safety being greater than the emergency impact force needed to permanently deform said second impact safety so that said second impact safety yields before said first impact safety, said central buffer coupler including a resilient buffer device connected between said web plate and said second impact safety for resiliently absorbing normal impacct force which is less than either of the emergency impact forces, said fender including the central fender part connected to said shock bar and a side fender part hinged ot each side of said central fender part, and a shock rod connecting said web plate to each side fender part, said shock rod comprising a plurality of telescopic parts including at least one deformable excess impact part movable in respect to another excess impact part, said shock rod hinged to said web plate for substantially horizontal pivotal movement.

* * * * *